US005603994A

United States Patent [19]

Su

[11] Patent Number: 5,603,994

[45] Date of Patent: Feb. 18, 1997

[54] MOVABLE DECORATION ASSEMBLY

[76] Inventor: Chung S. Su, No. 76, Kai Shan Road, Tainan, Taiwan

[21] Appl. No.: 528,234

[22] Filed: Sep. 14, 1995

[30] Foreign Application Priority Data

Oct. 22, 1994 [CN] China ..... 94 2 43251.7

[51] Int. Cl.[6] ..... H01F 1/00

[52] U.S. Cl. ..... 428/11; 40/426; 428/13; 428/16; 428/900; 446/136

[58] Field of Search ..... 428/7, 11, 13, 428/16, 900; 40/406, 426; 446/136

[56] References Cited

U.S. PATENT DOCUMENTS

| | | | |
|---|---|---|---|
| 3,239,956 | 3/1966 | Canonica, Jr. | 446/136 X |
| 4,757,986 | 7/1988 | Hwang et al. | 428/13 X |
| 4,852,283 | 8/1989 | Teng | 428/13 X |
| 5,146,701 | 9/1992 | Lee | 428/13 X |
| 5,301,444 | 4/1994 | Horiuchi | 40/426 |
| 5,405,465 | 4/1995 | Horiuchi | 40/426 X |

*Primary Examiner*—Henry F. Epstein
*Attorney, Agent, or Firm*—Bacon & Thomas

[57] ABSTRACT

A movable decoration assembly comprises a hollow globe, a seat and a driving device. The seat has an upper casing and a lower casing to define a hollow chamber for receiving a driving device. The globe is disposed on the upper casing. The driving device has a motor to drive the first and the second shafts to rotate in the opposite directions. The first magnet is connected and driven by the first shaft. The second magnet is connected and driven by the second shaft. A cell is disposed in the cell chamber inside the lower casing. A switch is inside the lower casing. The switch and the cell control the rotation of the motor. The movable article has two symmetric parts adhered together. An air chamber is defined by the symmetric parts of the article. A magnetic body is disposed in the air chamber.

8 Claims, 7 Drawing Sheets

MOVABLE DECORATION ASSEMBLY

BACKGROUND OF THE INVENTION

The invention relates to a movable decoration assembly. More particularly, the invention relates to an artificial fish decoration assembly which contains at least one movable article and a driving device.

Conventional fish bowls and fish globes have a plurality of living animals such as fishes and turtles therein. However, people have to feed fishes and turtles everyday.

SUMMARY OF THE INVENTION

An object of the invention is to provide a movable decoration assembly which has at least a movable decoration to mimic living sea animals in a fish globe.

Another object of the invention is to provide a movable decoration assembly which can be combined with a conventional fish globe.

Accordingly, a movable decoration assembly comprises a hollow globe, a seat and a driving device. The globe has an upper opening, a flat bottom and a transparent periphery. The hollow interior of the globe receives a liquid and at least one movable article. The seat has an upper casing and a lower casing to define a hollow chamber for receiving a driving device. The upper casing and the lower casing are snapped together. The globe is disposed on the upper casing. The driving device has a motor to drive a gear assembly which in turn causes first and the second spaced shafts to rotate in opposite directions. The first magnet is connected and driven by the first shaft. The second magnet is connected and driven by the second shaft. A cell is disposed in the cell chamber inside the lower casing. A switch is inside the lower casing. The switch and the cell control the rotation of the motor. A magnetic body is disposed in the movable article.

DETAILED DESCRIPTION OF THE INVENTION

Figure 1:
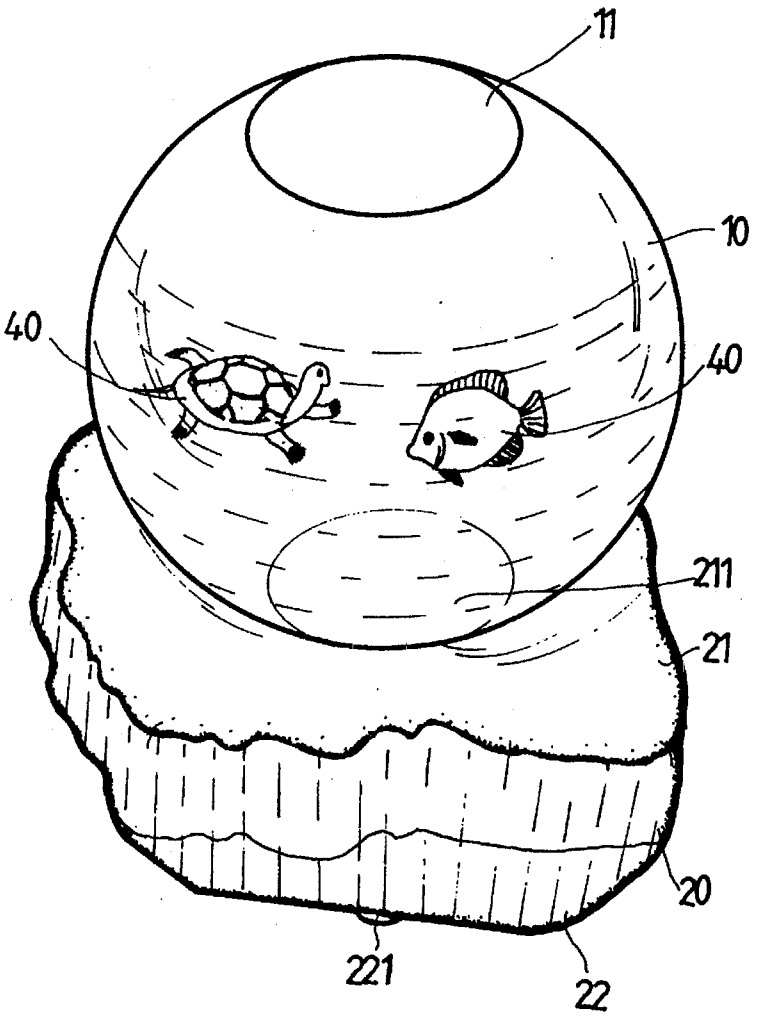
FIG. 1 is a perspective assembly view of a preferred embodiment in accordance with the invention.
Figure 2:
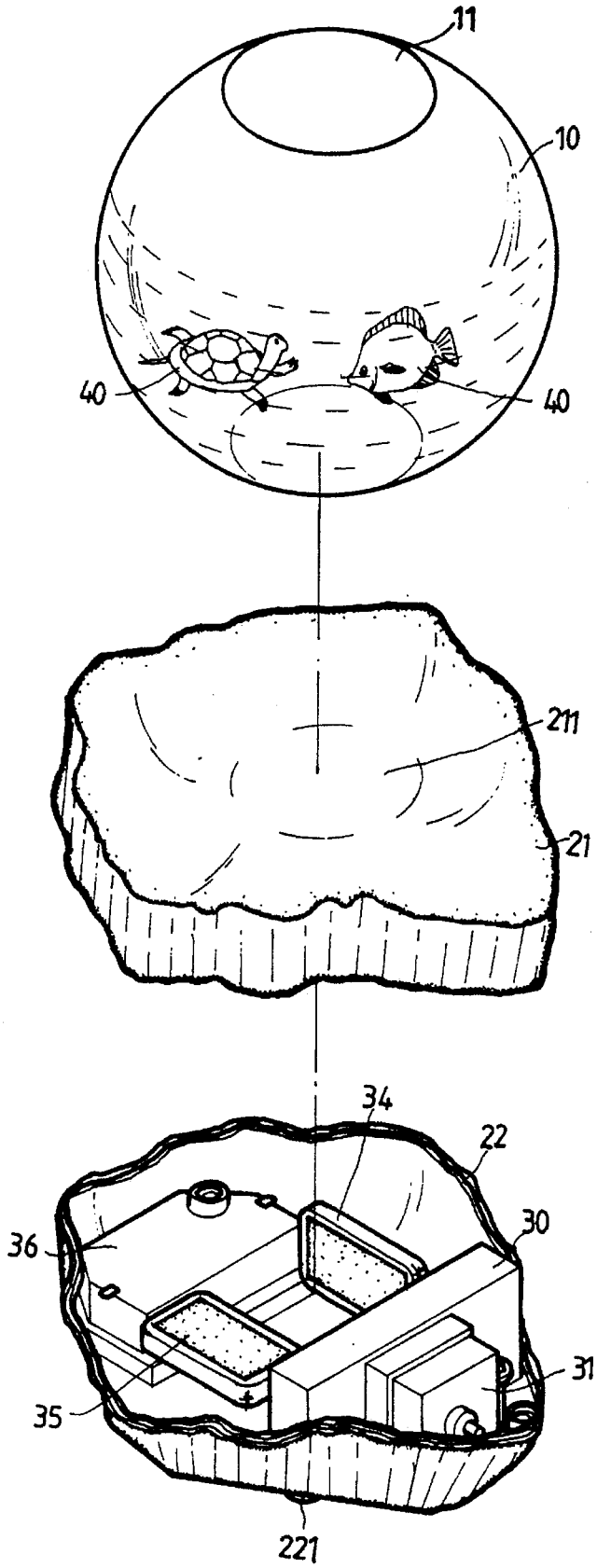
FIG. 2 is a perspective exploded view of FIG. 1.
Figure 3:
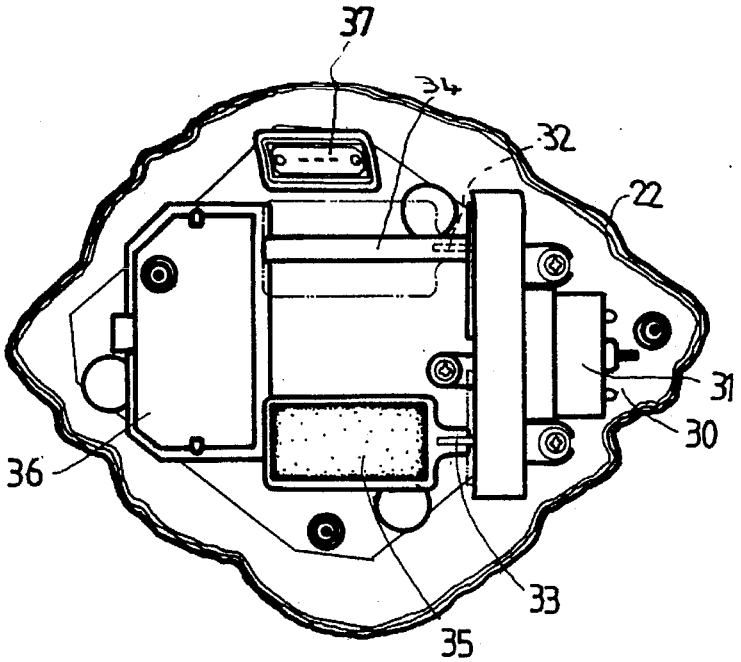
FIG. 3 is a top plan view of a driving device of a preferred embodiment in accordance with the invention.
Figure 4:
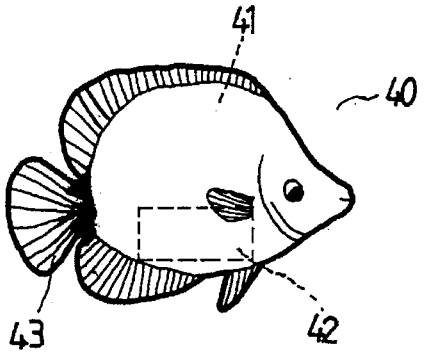
FIG. 4 is a side elevational view of a movable article of a preferred embodiment in accordance with the invention.
Figure 5:
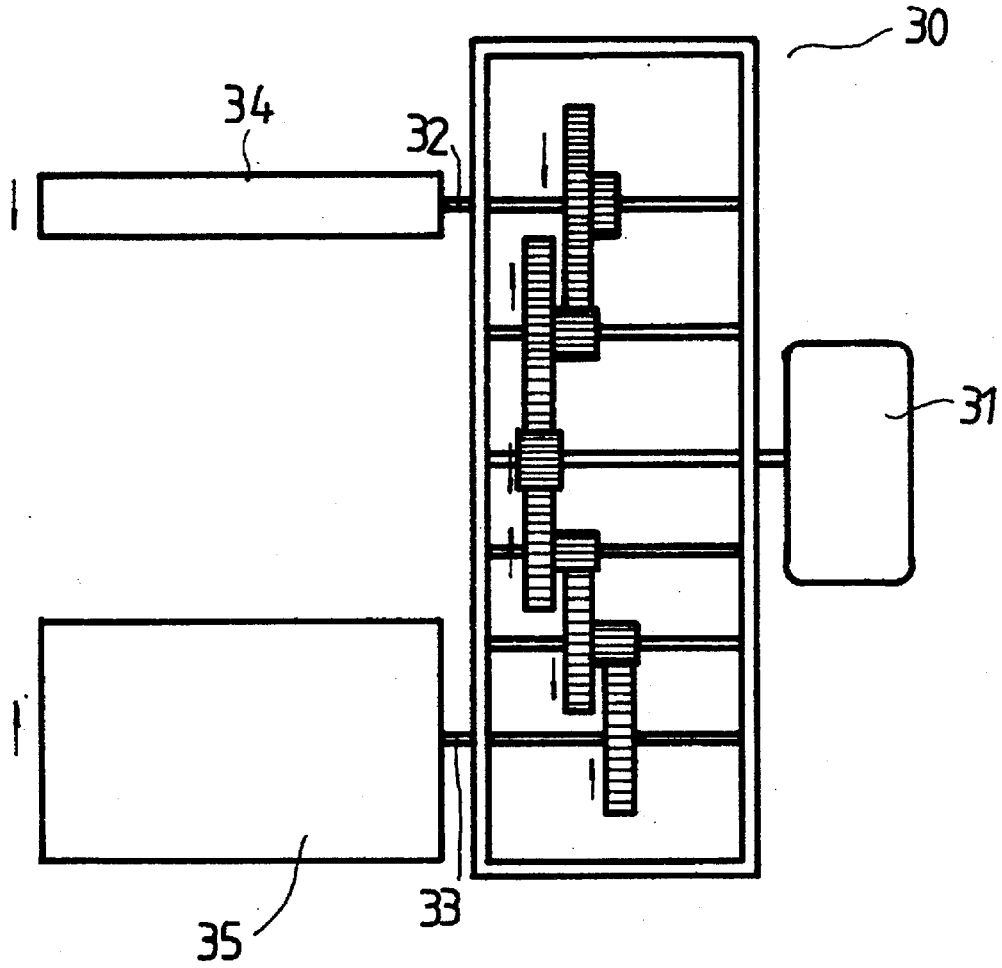
FIG. 5 is a schematic view illustrating the operation of a driving device.

Referring to FIGS. 1 and 2, a movable decoration assembly comprises a hollow globe 10, a seat 20 and a driving device 30. The globe 10 has an upper opening 11, a flat bottom and a transparent peripheral wall. The hollow interior of the globe 10 receives a liquid and a plurality of movable articles 40 such as artificial fishes and turtles. The seat 20 has an upper casing 21 and a lower casing 22 to define a hollow chamber for receiving a driving device 30. The upper casing 21 and the lower casing 22 are snapped together. At least a pad 221 is disposed beneath the lower casing 22. The globe 10 is disposed on the upper surface 211 of the upper casing 21. Referring to FIGS. 2, 3 and 5, the driving device 30 has a motor 31 and a plurality of gears to drive the first and the second shafts 32 and 33 to rotate same in opposite directions. The rotational speed of the first shaft 32 is different from that of the second shaft 33. The first magnet 34 is connected to and driven by the first shaft 32. The second magnet 35 is connected to and driven by the second shaft 33. Thus the magnetic field of the first magnet 34 and that of the second magnet 35 influence each other to form a fluctuating magnetic field. A power cell or battery disposed in the cell chamber 36 inside the lower casing 22. A switch 37 is inside the lower casing 22 also. The switch 37 and the cell control the operation of the motor 31 and rotation of shafts 32 and 33. The movable article 40 has two symmetric parts adhered together and a tail 43. An air chamber 41 is defined by the symmetric parts of the article 40. A magnetic body 42 is disposed in the air chamber 41. The specific gravity of the movable article 40 is similar to that of the liquid. The fluctuating magnetic field of the driving device 30 will influence the magnetic field produced by the magnetic body 42 so that the movable article 40 can swim in the liquid.

Figure 6:
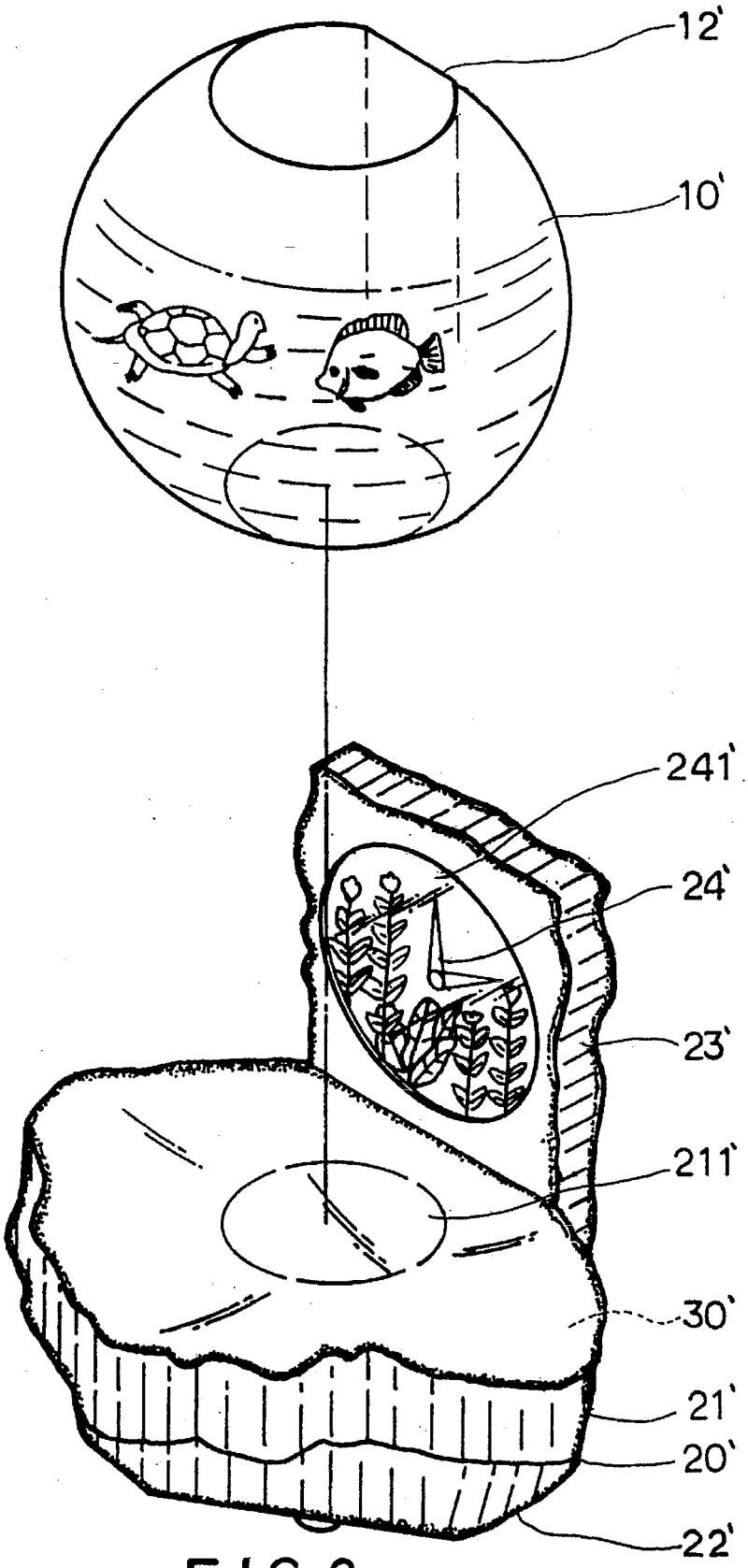
FIG. 6 is a perspective view of a globe and a seat of another preferred embodiment in accordance with the invention.
Figure 7:
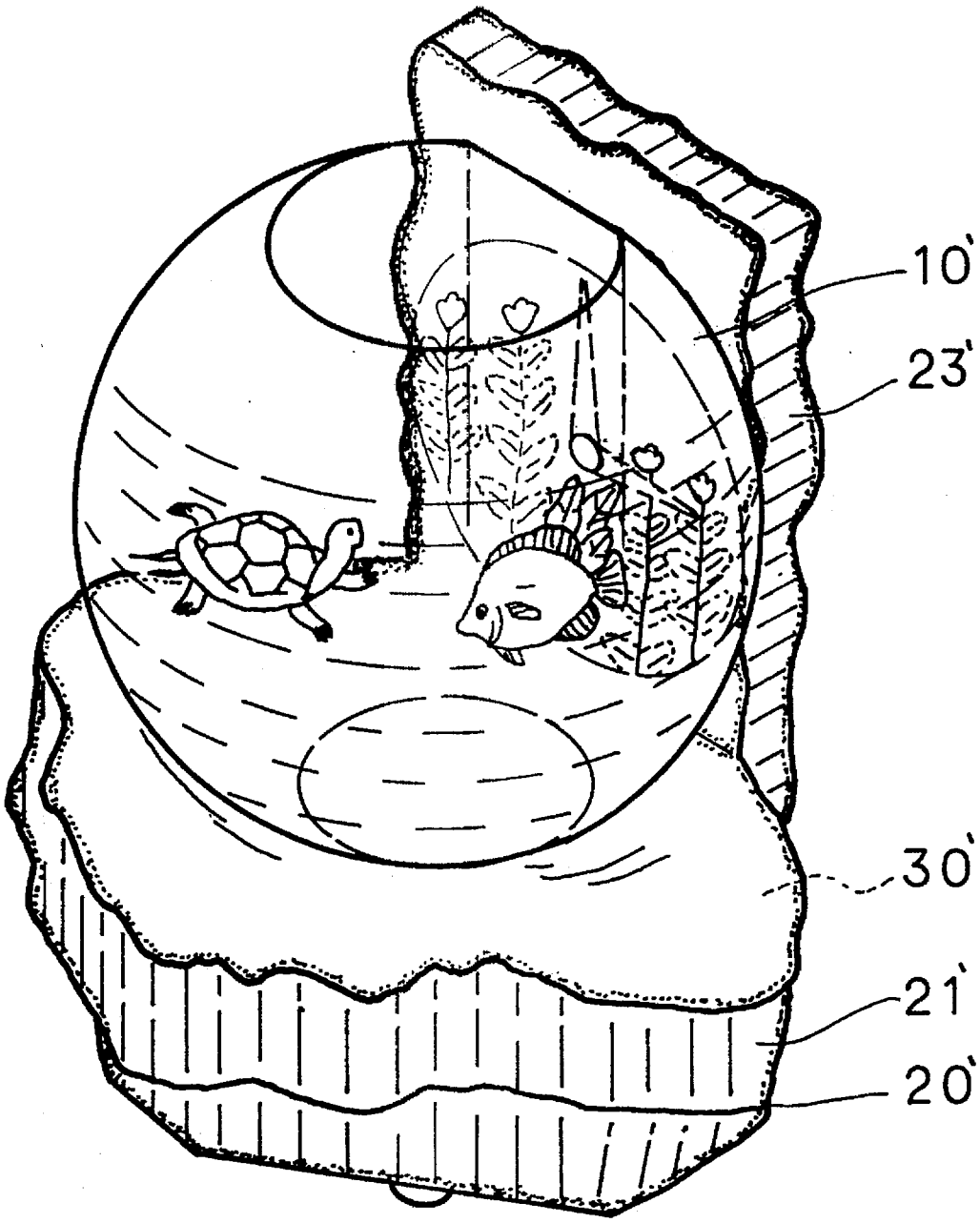
FIG. 7 is a perspective assembly view of FIG. 6.
Figure 8:
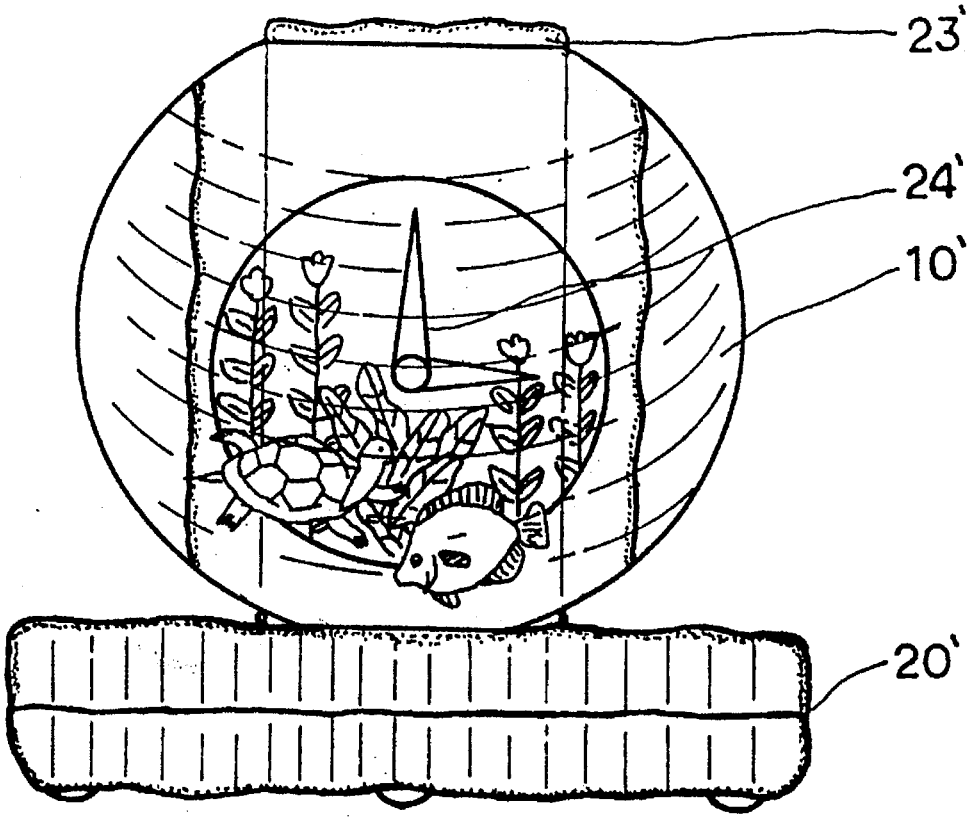
FIG. 8 is a front elevational view of FIG. 7.

Referring to FIGS. 6 to 8, a movable decoration assembly comprises a hollow globe 10', a seat 20' and a driving device 30'. The driving device 30' is the same as the driving device 30. The globe 10' has an upper opening, a flat bottom, a transparent peripheral wall that includes a flat rear wall 12'. The hollow interior of the globe 10 receives a liquid and a plurality of movable articles. The seat 20' has an upper casing 21' and a lower casing 22' to define a hollow chamber for receiving a driving device 30'. The upper casing 21' and the lower casing 22' are snapped together. The globe 10' is disposed on the upper surface 211' of the upper casing 21'. A flat plate 23' is connected to a longitudinal edge of the seat 20'. A transparent frame 241' is disposed at the center of the flat plate 23'. A clock 24' is disposed in the frame 241'. The rear wall 12' is adjacent to the flat plate 23'.

The invention is not limited to the above embodiment but various modification thereof may be made. It will be understood by those skilled in the art that various changes in form and detail may be made without departing from the spirit and scope of the invention.

I claim:

1. A movable decoration assembly comprising:

a) a hollow globe including an upper opening, a flat bottom, a transparent peripheral wall, and a hollow interior for containing a liquid and at least one movable article carrying a magnetic body for producing a magnetic field;

b) a seat including an upper casing and a lower casing, the upper and lower casings being joined together and defining a hollow chamber therebetween, and the flat bottom of the hollow globe being engageable on the upper casing for supporting the hollow globe on the seat;

c) a driving device disposed within the hollow chamber of the seat, the driving device including a motor, a power supply for operating the motor, a switch for connecting and disconnecting the power supply with the motor, a pair of spaced shafts, and a gear assembly driven by the motor for rotating the spaced shafts in opposite directions and at different speeds; and d) a magnet carried and rotated by each shaft to create a fluctuating magnetic field for influencing the magnetic field produced by the magnetic body of the article and cause the article to move about the liquid.

2. A movable decoration assembly as claimed in claim 1, wherein at least one pad is disposed beneath said lower casing.

3. A movable decoration assembly as claimed in claim 1, wherein said movable article includes two symmetrical parts adhered together to define an air chamber therein.

4. A movable decoration assembly as claimed in claim 1, wherein said globe has a flat rear wall.

5. A movable decoration assembly as claimed in claim 4, wherein a flat plate is connected to a longitudinal edge of said seat.

6. A movable decoration assembly as claimed in claim 5, wherein said flat plate has a transparent frame disposed at a center of said flat plate.

7. A movable decoration assembly as claimed in claim 6, wherein said transparent frame has a clock disposed in said transparent frame.

8. A movable decoration assembly as claimed in claim 5, wherein said flat rear wall is disposed adjacent to said flat plate.

* * * * *